US008337683B2

(12) United States Patent
Choi et al.

(10) Patent No.: US 8,337,683 B2
(45) Date of Patent: Dec. 25, 2012

(54) MICROFLUIDIC SENSOR COMPLEX STRUCTURE

(75) Inventors: Moon Hee Choi, Seoul (KR); Seung Hyeun Jung, Seoul (KR); Young Hoon Kim, Monmouth Junction, NJ (US); Joo-Heon Park, Monmouth Junction, NJ (US); Hakhyun Nam, Seoul (KR); Geun Sig Cha, Seoul (KR)

(73) Assignees: i-Sens, Inc., Seoul (KR); Nano-Ditech Corporation, Monmouth Junction, NJ (US)

( * ) Notice: Subject to any disclaimer, the term of this patent is extended or adjusted under 35 U.S.C. 154(b) by 254 days.

(21) Appl. No.: 12/670,817

(22) PCT Filed: Jul. 24, 2008

(86) PCT No.: PCT/KR2008/004336

§ 371 (c)(1),
(2), (4) Date: Jan. 26, 2010

(87) PCT Pub. No.: WO2009/014390

PCT Pub. Date: Jan. 29, 2009

(65) Prior Publication Data

US 2010/0200428 A1 Aug. 12, 2010

(30) Foreign Application Priority Data

Jul. 26, 2007 (KR) ..... 10-2007-0075254

(51) Int. Cl.
*B67D 1/00* (2006.01)

(52) U.S. Cl. ..... 204/403.14; 422/502; 422/503

(58) Field of Classification Search ..... 204/403.01–403.15; 205/777.5, 205/778, 792; 600/345–348; 435/4–40.52; 422/68.1–98; 436/62–71, 500–548
See application file for complete search history.

(56) References Cited

U.S. PATENT DOCUMENTS

| | | | | |
|---|---|---|---|---|
| 6,776,888 | B2 * | 8/2004 | Yamamoto et al. | 204/403.09 |
| 2004/0072357 | A1 * | 4/2004 | Stiene et al. | 436/69 |
| 2005/0133101 | A1 * | 6/2005 | Chung et al. | 137/833 |
| 2006/0078873 | A1 * | 4/2006 | Ogawa et al. | 435/4 |

FOREIGN PATENT DOCUMENTS

| | | |
|---|---|---|
| EP | 1688742 | 8/2006 |
| KR | 1020030004933 | 1/2003 |

* cited by examiner

*Primary Examiner* — Alex Noguerola
*Assistant Examiner* — Gurpreet Kaur
(74) *Attorney, Agent, or Firm* — Nelson Mullins Riley & Scarborough LLP; EuiHoon Lee, Esq.

(57) ABSTRACT

Disclosed is a microfluidic sensor complex structure comprising a lower plate, a middle plate and an upper plate. A reference electrode, a working electrode and an electrode connection are formed on the lower plate. The middle plate comprises a microfluidic channel passage therein. The upper plate is overlaid on the middle plate so as to induce a capillary phenomenon on the microfluidic channel passage formed on in the middle plate. The microfluidic sensor complex structure allows the motion of a sample to be driven only by a capillary phenomenon, without additional operation, and allows an immune response, washing, and electrochemical analysis in one round once a sample is introduced thereinto. Hence, it requires only a short time period for measurement, is convenient to handle, and shows sensitivity and selectivity. Also, it can be produced on a mass scale because it can be formed of typical organic polymers using a simple method. Based on analytical electrochemistry, the microfluidic sensor complex structure can be used as a small-size sensor that can be applied to practice sites.

11 Claims, 10 Drawing Sheets

MICROFLUIDIC SENSOR COMPLEX STRUCTURE

RELATED APPLICATIONS

This application is a 35 U.S.C. §371 national stage filing of PCT Application No. PCT/KR2008/004336 filed on Jul. 24, 2008, which claims priority to, and the benefit of, Korean Patent Application No. 10-2007-0075254 filed on Jul. 26, 2007. The contents of the aforementioned applications are hereby incorporated by reference.

TECHNICAL FIELD

The present invention relates to a microfluidic sensor complex structure in which an immune response, a washing process, substrate introduction and an analytical signal generation can be conducted sequentially once a sample is introduced thereinto.

BACKGROUND ART

With the greatly increased concern about the quality of life brought by remarkable advances in science and technology, the significance of disease diagnosis and prophylaxis, quality assurance of foods and full monitoring of environment is ever increasing. As a result, there is a great need for quantitative measurement of organic or inorganic analytes of interests on site, and in fact, the ability to accurately determine levels of organic or inorganic analytes is indispensable for the diagnosis of diseases, specific quality control processes in the food chemistry or industrial chemistry fields, and the monitoring of pollutants in the environment industry. Many attempts have been made to improve accuracy in the quantitative analysis of organic, inorganic and biological material of interests.

Also, interest in techniques for handling and delivering very small amounts of samples or reagents has been increasing, as the micro scale analysis becomes possible due to the development of science and technology. Biosensor technology is receiving a great attention as a means for handling infinitesimal amounts of samples or reagents in a variety of research and development fields, for example, clinical tests, test for the freshness and contamination of foods, control in biological processes, environmental monitoring, etc., because it allows rapid and convenient analyses of various materials of interests.

A biosensor is a device for the detection of an analyte that combines a biological component, such as enzyme, microbe, antibody, natural or artificial receptor, DNA probe, etc., with a detector component, which is structured to associate a biosubstance with an electronic or physiochemical transducer, to react it with signal generating element to cause a physical change in electro active analyte, and to detect the analyte or the change in electrochemical, optical, thermal or piezoelectric way. Immunosensor, which is designed based on the principle of specific recognition of an antibody for an antigen, shows high selectivity and a low detection limit, and is thus attracting great attention as a diagnostic sensor for use in the medical field.

Immunosensors are primarily based on solid-phase sandwich enzyme immunoassay. In a solid-phase sandwich enzyme immunoassay, an antigen is bound to an immobilized antibody and is then associated at a different epitope with a secondary antibody-enzyme conjugate. The solid-phase sandwich enzyme immunoassay is known to have higher sensitivity than other immunoassays. For example, an immune response in a matrix which is used as a reaction site for a solid-phase competitive immunoassay may be interrupted due to the steric hindrance of other substances. In case of the sandwich enzyme immunoassay, however, an immune response occurs only at an epitope site, so that it is interrupted to a much lesser extent than in the competitive immunoassay, thus generating sensitive signal. In a sandwich enzyme immunoassay, pathogens, viruses, cells, etc., which retain analytes of interest, typically large-size proteins, are bound to immobilized antibodies, washed, and associated with a secondary antibody-enzyme conjugate. Therefore, the amount of the labeling enzyme remaining on the solid phase is proportional to the amount of the analyte. After the removal of the secondary antibody-enzyme conjugate by washing, the amount of the labeling enzyme can be detected by measuring the rate of reaction with a substrate. Showing better specificity and sensitivity, particularly for protein analytes, a sandwich enzyme immunoassay is widely applied to the analysis of clinically important blood proteins.

A lab-on-a-chip is a chemical microprocessor made by integrating many kinds of devices on a plate (or chip) that is only a few square centimeters in size and is made of glass, silicon or plastic using photolithography or micromachining, generally used in semiconductor technology. As such, the lab-on-a-chip can be used to conduct automated experiments at a high throughput, high efficiency and low cost.

This micro analysis system is emerging as an important technology in the pharmaceutical industry, which has recently grown sharply, because it can significantly reduce the cost and time necessary to search for new drugs. In addition, lab-on-a-chip is a core technology which can find applications in a variety of fields, including medical diagnosis instruments, bedside health monitoring devices, chemical or biological process monitoring, portable analytical equipment for testing for environmental pollutants, unmanned chemical/biological agent detection/discerning apparatuses, etc.

Conventional lab-on-a-chip sensors, however, have problematic structures in terms of mass production. In consideration of the fact that lab-on-a-chip technology is applied, in the most part, to disposable biochemical sensors, conventional structures are difficult to produce at low cost and high reliability. Further, conventional biosensors in lab-on-a-chip are complicated in structure because they use micro-valves, high voltage capillary electrophoresis, and/or combination of complicate miniaturized mechanical components for the delivery of fluid through channels and require washing processes.

Leading to the present invention, the inventors intensively researched the biosensors which are easy to produce, convenient to carry and simple in constitution and suitable for mass production, devised a convenient and practical lab-on-a-chip system that drives a sample by capillary phenomena sequentially through dividing channels and reservoirs containing antibody-enzyme conjugate and signal generating substrates, respectively, and through antibody immobilized electrodes to washing channels for total enzyme-linked electrochemical immunoassay once the sample is injected.

DISCLOSURE OF INVENTION

Technical Problem

It is therefore an object of the present invention to provide a microfluidic sensor complex structure which has a simple constitution, is convenient to carry, and can be produced on a mass scale.

Technical Solution

In order to accomplish the above object, the present invention provides a microfluidic sensor complex structure, comprising: a lower plate, on which multitude of reference electrodes, working electrodes, fluid sensing electrodes and corresponding electrode connections are formed; a middle plate, overlaid on the lower plate, comprising therein: a sample inlet channel; a microfluidic channel passage, which extends from the sample inlet channel and serves as a guide along which a sample flows over the entire middle plate, and which is divided at a position near the sample inlet channel into two branches, on which an enzyme conjugate reservoir and a substrate reservoir are positioned, respectively, said two branches being confluent before a detection channel, at which the reference electrode and the working electrode are exposed; a mixing channel, positioned before a position of confluence on the microfluidic channel passage extending through the substrate reservoir, comprising an air discharge channel such that a sample flowing through the substrate reservoir reaches the detection channel later than does a sample flowing through the enzyme conjugate reservoir; an absorbing channel in which the sample fluid flowing out of the detection channel is absorbed; and an air inlet channel provided at an end of the absorbing channel; and an upper plate, overlaid on the middle plate so as to induce a capillary phenomenon on the microfluidic channel passage formed on in the middle plate.

In accordance with a preferred modification of the microfluidic sensor complex structure, the lower plate is provided with a fluidity sensing electrode for detecting arrival of the sample at the end of the absorbing channel of the middle plate.

In accordance with a preferred modification of the microfluidic sensor complex structure, the fluidity sensing electrode is configured to indicate a time point at which the substrate is allowed to advance further by detecting the arrival of the sample.

In accordance with a preferred modification of the microfluidic sensor complex structure, the lower plate is further provided with one or more verifying electrodes configured to minimize the deviation of detected signals.

In accordance with a preferred modification of the microfluidic sensor complex structure, the verifying electrodes are comprised of a first verifying electrode, for measuring a background signal, and a second verifying electrode for detecting a saturation signal of the saturated or partially saturated enzyme conjugate.

In accordance with a preferred modification of the microfluidic sensor complex structure, the middle plate is further provided with a filter pad channel and a filter pad, both of which are adapted to select only an analyte component of the sample.

In accordance with a preferred modification of the microfluidic sensor complex structure, the filter pad is designed to introduce only serum to the sample inlet channel.

In accordance with a preferred modification of the microfluidic sensor complex structure, the sample flowing out of the enzyme conjugate reservoir reaches the working electrode a predetermined time period earlier than does the sample flowing out of the substrate reservoir.

In accordance with a preferred modification of the microfluidic sensor complex structure, an antibody or a molecule-recognizing substance capable of inducing an immune response to an analyte of the sample are immobilized on the working electrode.

In accordance with a preferred modification of the microfluidic sensor complex structure, the detection channel is adapted to send the electrochemical signal, generated upon an enzyme-substrate reaction between the enzyme conjugate and the substrate fluid after the immune response of the antibody or molecule-recognizing substance to the analyte, so as to yield quantitative information on the analyte.

In accordance with a preferred modification of the microfluidic sensor complex structure, the absorbing channel maintains a capillary phenomenon over the microfluidic channel passage to drive movement of the sample, thereby continuing reactions in the detection channel, and serves to increase a washing effect on an unreacted material to produce highly sensitive detection signals.

In accordance with a preferred modification of the microfluidic sensor complex structure, the upper plate is overlaid on the middle plate in such a manner as to expose the sample inlet channel and a terminal region of the absorbing channel, thereby inducing a capillary phenomenon on the microfluidic sensor complex structure.

In accordance with an aspect thereof, the present invention provides a method for quantitatively analyzing an analyte using the microfluidic sensor complex structure.

Advantageous Effects

The microfluidic sensor complex structure according to the present invention allows the motion of a sample to be driven only by a capillary phenomenon, without additional operation, and allows an immune response, washing, and electrochemical analysis in one round once a sample is introduced thereinto. Accordingly, the microfluidic sensor complex structure requires only a short time period for measurement, is convenient to handle, and shows sensitivity and selectivity. Also, the microfluidic sensor complex structure can be produced on a mass scale because it can be formed of typical organic polymers using a simple method. Based on analytical electrochemistry, the microfluidic sensor complex structure can be used as a small-size sensor that can be used on sites.

BRIEF DESCRIPTION OF THE MARK OF DRAWINGS

Figure 1:
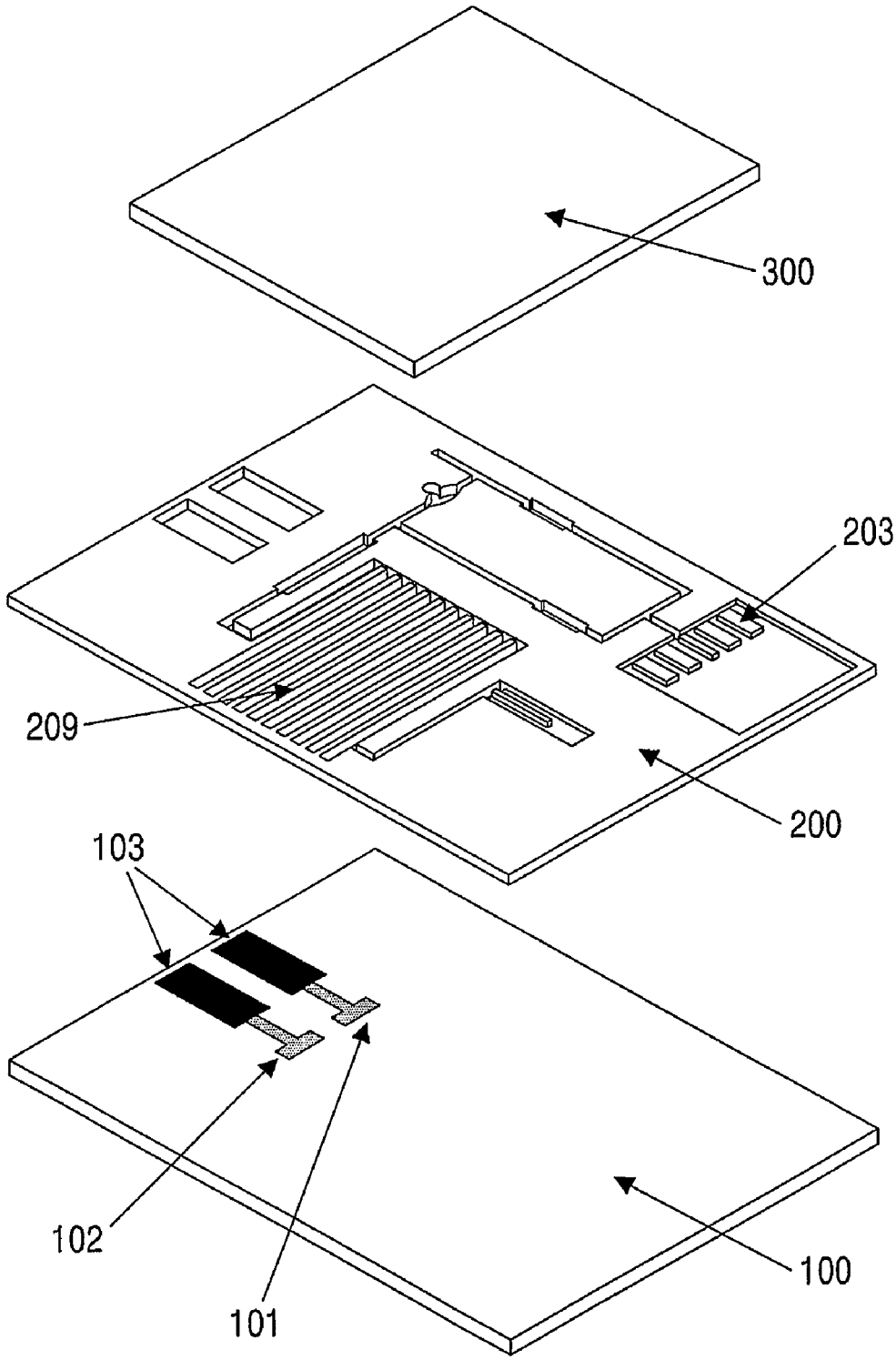
FIG. 1 is an exploded perspective view showing a microfluidic sensor complex structure according to one embodiment of the present invention.

100: lower plate
101: working electrode
102: reference electrode
103: electrode connection
104: fluid sensing electrode
105: first verifying electrode
106: second verifying electrode
107: flow sensing electrode
108: biosensor confirming electrode
200: middle plate
201: blood filter pad channel
202: blood filter pad
203: sample inlet channel
204: enzyme conjugate reservoir
205: substrate reservoir
206: mixing channel
207: air discharge channel
208: detection channel
209: absorbing channel
210: air inlet channel
300: upper plate

BEST MODE FOR CARRYING OUT THE INVENTION

Reference should now be made to the drawings, in which the same reference numerals are used throughout the different drawings to designate the same or similar components.

Figure 2:
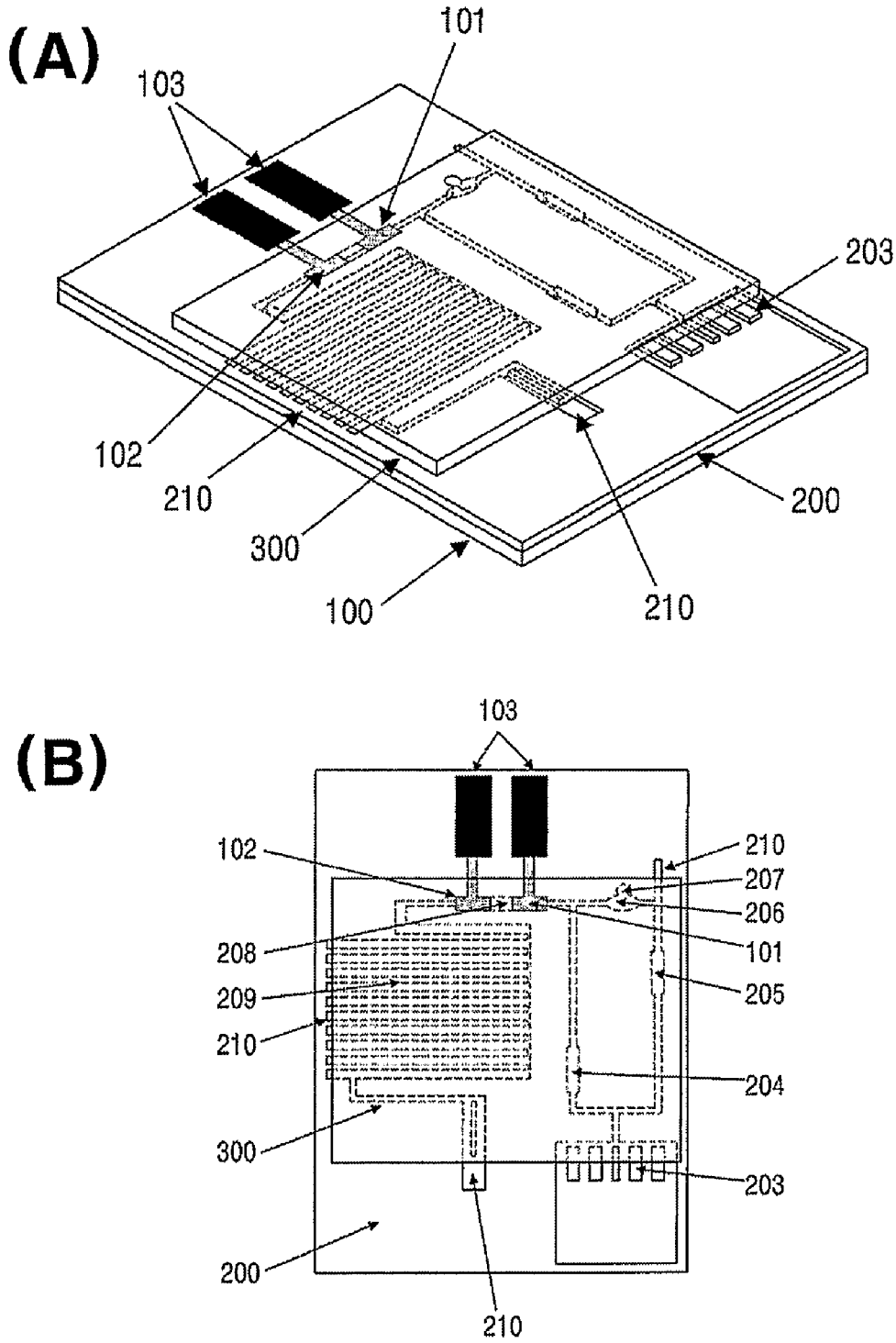
FIG. 2 shows an assembled configuration of the microfluidic sensor complex structure of FIG. 1 in a perspective view and a plan view.

With reference to FIG. 1, a microfluidic sensor complex structure according to one embodiment of the present invention is shown in an exploded perspective view. Its assembled configuration is presented both in a perspective view and in a plan view in FIG. 2.

As seen in these figures, the microfluidic sensor complex structure according to one embodiment of the present invention is a laminate structure comprising a lower plate 100, on which an electrode unit, consisting of a working electrode 101, a reference electrode 102 and an electrode connection 103, is formed; a middle plate 200, provided with a sample inlet channel 203, an absorbing channel 209, and a microfluidic channel, which extends from the sample inlet channel 203 to the absorbing channel 209 through the electrode unit; and an upper plate (or a cover) 300.

The lower plate 100 is made of an organic polymer, such as polyethylene, polyethylene terephthalate (PET), polycarbonate, etc. The electrode unit is formed by patterning an electroconductive material on the lower plate 100 through a screen-printing method or a physical/chemical evaporation deposition method.

Figure 9:
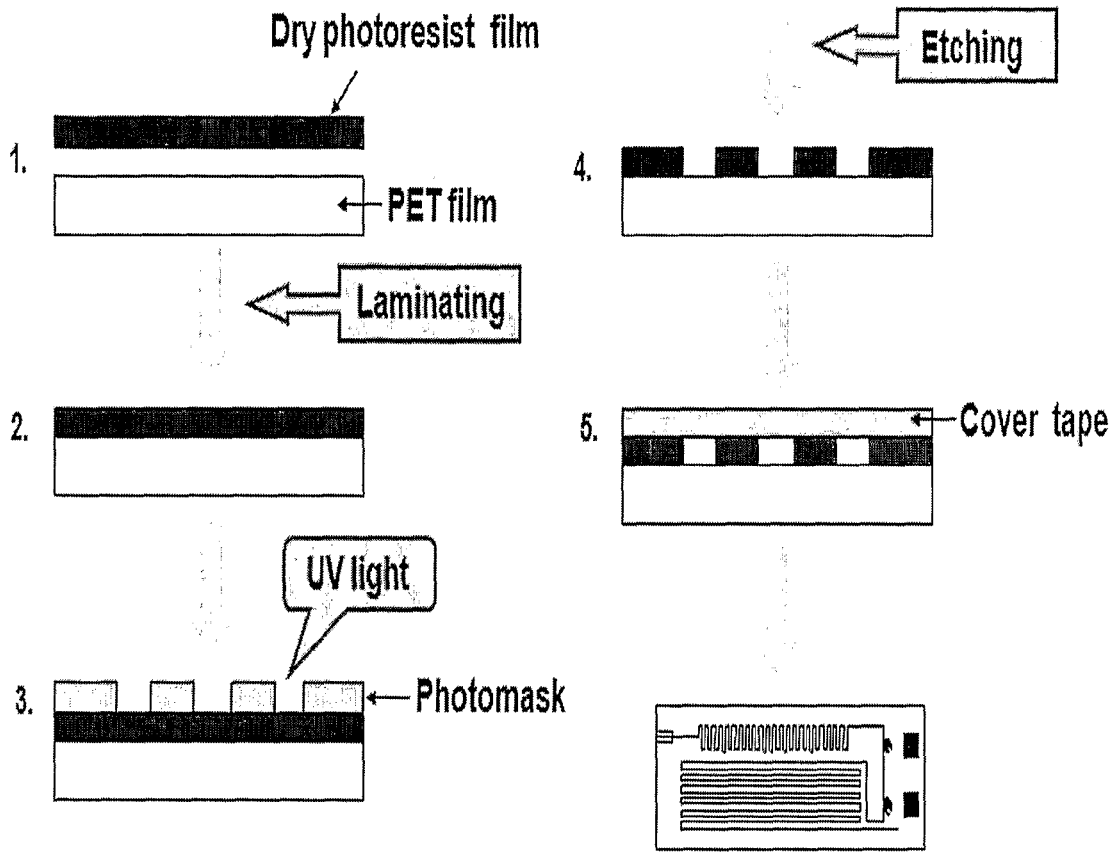
FIG. 9 is a view showing a process of forming a microfluidic channel passage for a microfluidic sensor complex structure according to an embodiment of the present invention.

The middle plate 200 may be made of the same material as the lower plate 100. The microfluidic channels may be provided through a press molding process. For instance, a double-sided tape made of the material is pressed against a mold. Preferably, the microfluidic channel is fabricated on a dry photoresist film using photolithography. For example, a dry photoresist film is thermally adhered to the lower plate 100 at 70° C. or higher temperature through the rollers of laminator and is then overlaid with a photomask film on which a microfluidic channel is designed, followed by etching exposed portions with an etchant to form a median layer 200 on the lower plate 100, with a microfluidic channel formed therein (see FIG. 9).

Serving as a cover, the upper plate 300 is overlaid on the middle plate so as to complete the microfluidic channel capable of inducing the capillary phenomenon. The upper plate 300 may be transparent or opaque, and the material therefor is determined depending on the method of fabricating the microfluidic channel. For example, when a dry photoresist film is used to construct the middle plate 200, the upper plate 300 is made of an organic polymer, with an adhesive applied to the face in contact with the middle plate 200.

The upper plate 300 is placed on the middle plate 200 in such a manner as to expose the sample inlet channel 203 and a terminal region of the absorbing channel 209. Thus, the exposed terminal region acts as an air inlet channel 210 to induce a capillary phenomenon.

Figure 3:
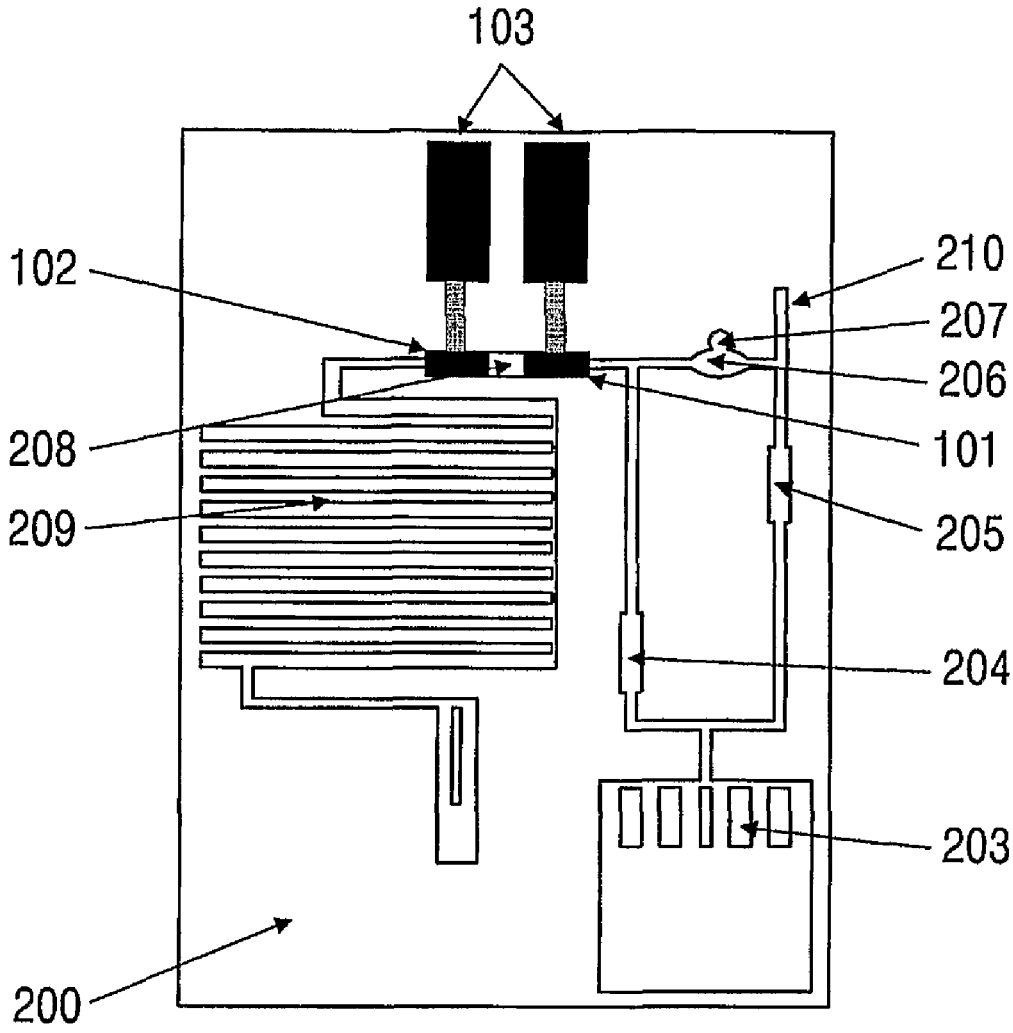
FIG. 3 is a plan view showing the microfluidic sensor complex structure of FIG. 1.

With reference to FIG. 3, the microfluidic sensor complex structure of FIG. 1 is shown in a plan view with the upper plate 300 removed therefrom.

In the middle plate 200, as seen in FIG. 3, a microfluidic channel is fabricated to comprise a sample inlet channel 203, an enzyme conjugate reservoir 204, a substrate reservoir 205, an air discharge channel 207, a detection channel 208, and an absorbing channel 209 for maintaining the flow of a sample to induce a continuous reaction and cleaning effect. After the sample inlet channel 203, the microfluidic channel is branched into two passages, on which the enzyme conjugate reservoir 204 and the substrate reservoir 205 are located, respectively.

Figure 4:
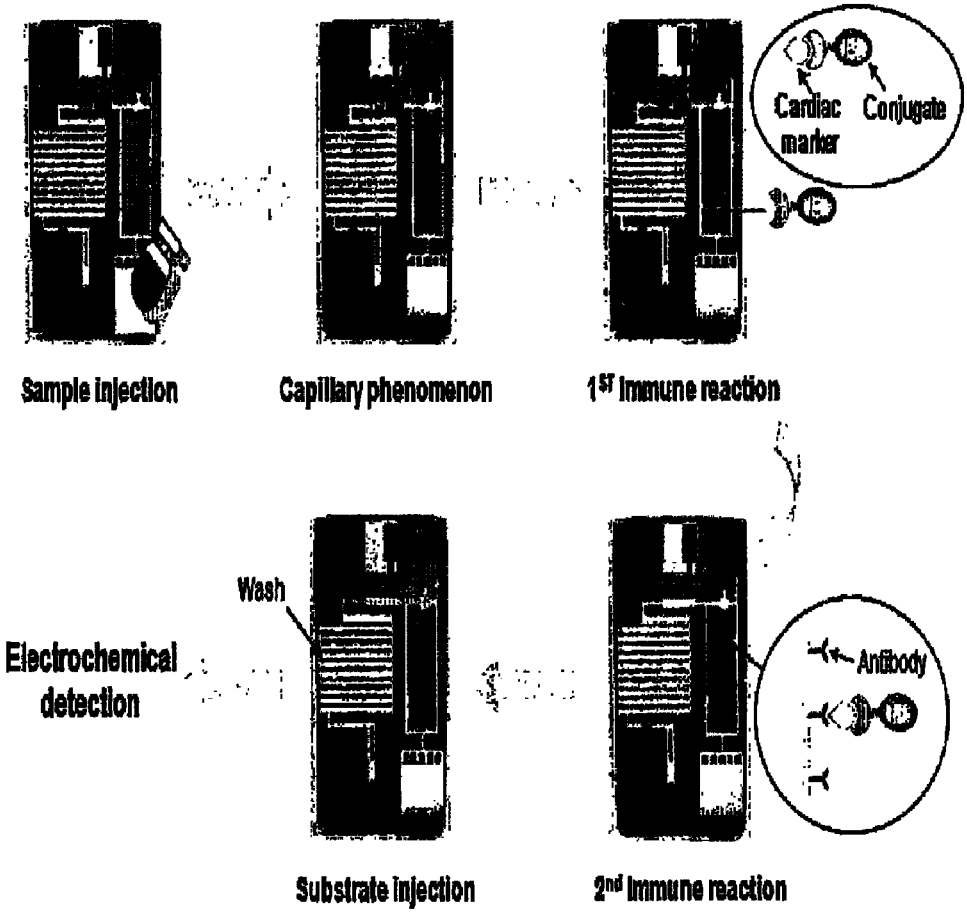
FIG. 4 is a view showing the reaction route along which an analyte of interest contained in a sample is reacted in the microfluidic sensor complex structure according to one embodiment of the present invention.

While flowing along the microfluidic channel provided in the microfluidic sensor complex, an analyte of interest contained in a sample reacts according to a reaction route set forth therein, with reference to FIG. 4.

As shown in FIG. 4, a sample introduced into the sample inlet channel is delivered through the two branched passages by a capillary phenomenon. While flowing along the branched passages, the sample fluid dissolves the enzyme conjugate and the substrate stored in their respective reservoirs 204 and 205 located on the passages. The enzyme conjugate dissolved by the sample in the reservoir 204 is bound to a specific site of an analyte of interest contained in the sample. Near the entry of the detection channel 208, in which the electrode unit is formed, the flow of the sample fluid becomes different between the two branched passages. Whereas the sample containing the analyte bound to the enzyme conjugate moves toward the electrode unit of the detection channel 208, the sample containing the substrate cannot advance further, but remains in a mixing channel 206 because the capillary phenomenon is not maintained due to the blockage of air discharge by the sample flowing from the enzyme conjugate reservoir 204. At this time, an immune response occurs between the analyte of the sample and an antibody or a molecule-recognizing substance immobilized on the working electrode 101. After the immune response, when the air discharge channel 207 is open, the substrate-containing sample stored in the mixing channel 206 is advanced to the working electrode 101 because the capillary phenomenon is maintained by the absorbing channel 209. As soon as the enzyme conjugate, remaining unreacted in the detection channel 208, is washed, the substrate induces signal generation. The signal varies in intensity depending on the concentration of the analyte, which allows electrochemical analysis.

Once a sample is introduced into the microfluidic sensor complex structure according to the present invention, therefore, the microfluidic channel constitution thereof allows an immune response, washing, and electrochemical analysis.

Figure 5:
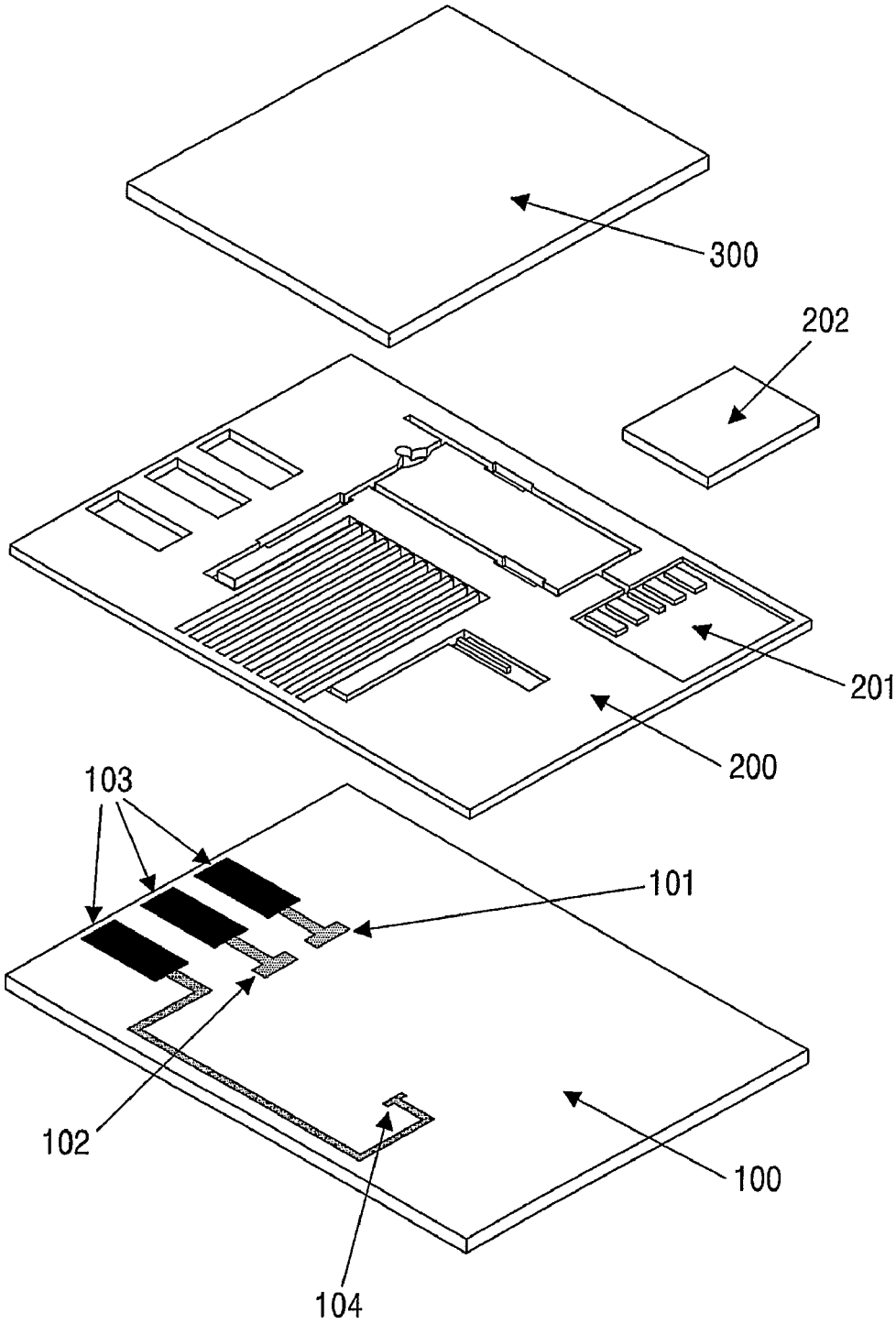
FIG. 5 is an exploded perspective view showing a microfluidic sensor complex structure according to one embodiment of the present invention.

With reference to FIG. 5, a microfluidic sensor complex structure according to another embodiment of the present invention is shown in an exploded perspective view. Its assembled configuration is presented in both a perspective view (a) and a plan view (b) in FIG. 6. FIG. 7 shows the microfluidic channel constitution of the microfluidic sensor complex structure in a plan view.

In accordance with this embodiment, the microfluidic sensor complex structure comprises a filter pad channel and a filter pad in the median layer, which are both adapted to select only an analyte component of the sample.

Figure 6:
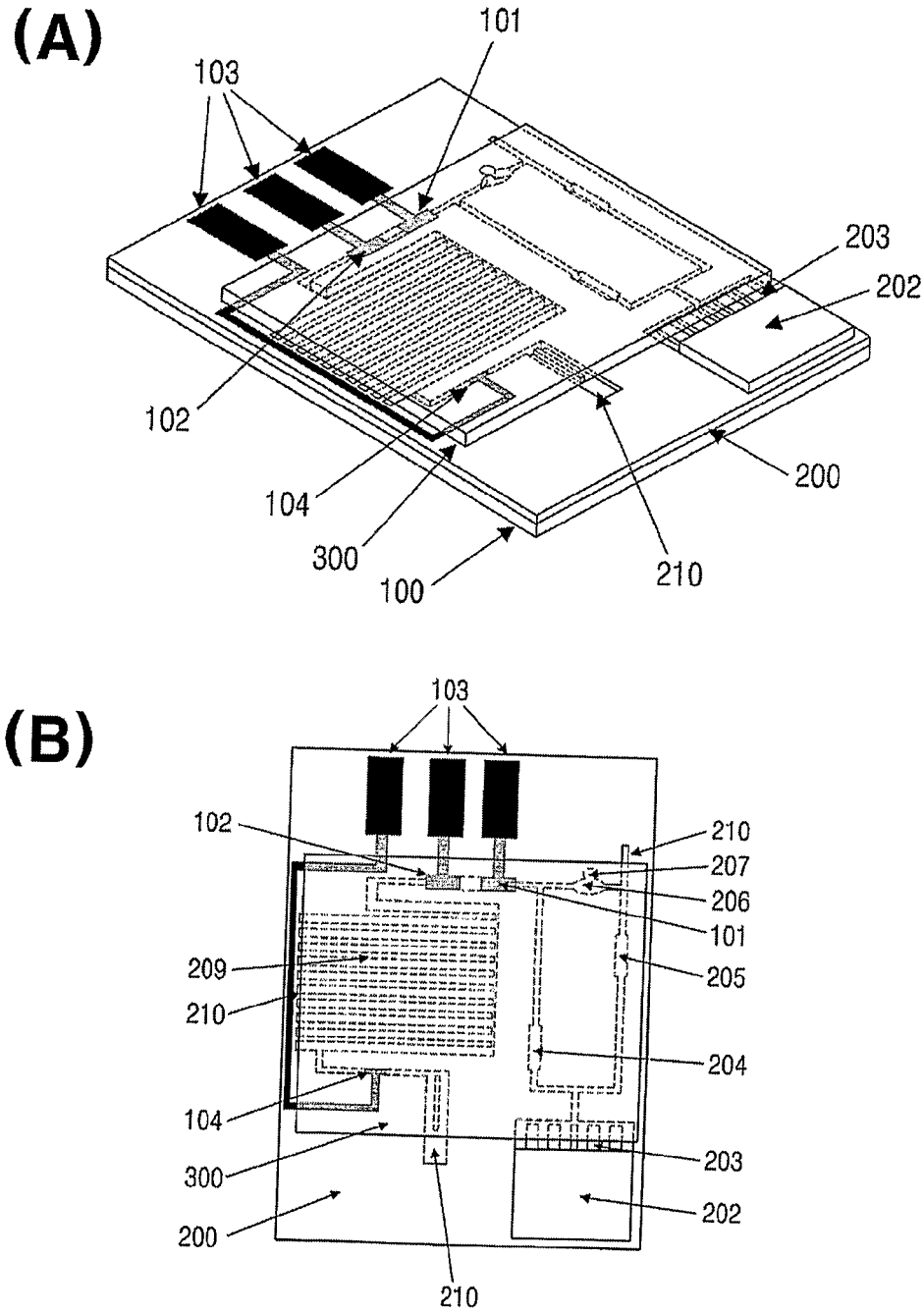
FIG. 6 shows an assembled configuration of the microfluidic sensor complex structure of FIG. 5 in a perspective view and a plan view.
Figure 7:
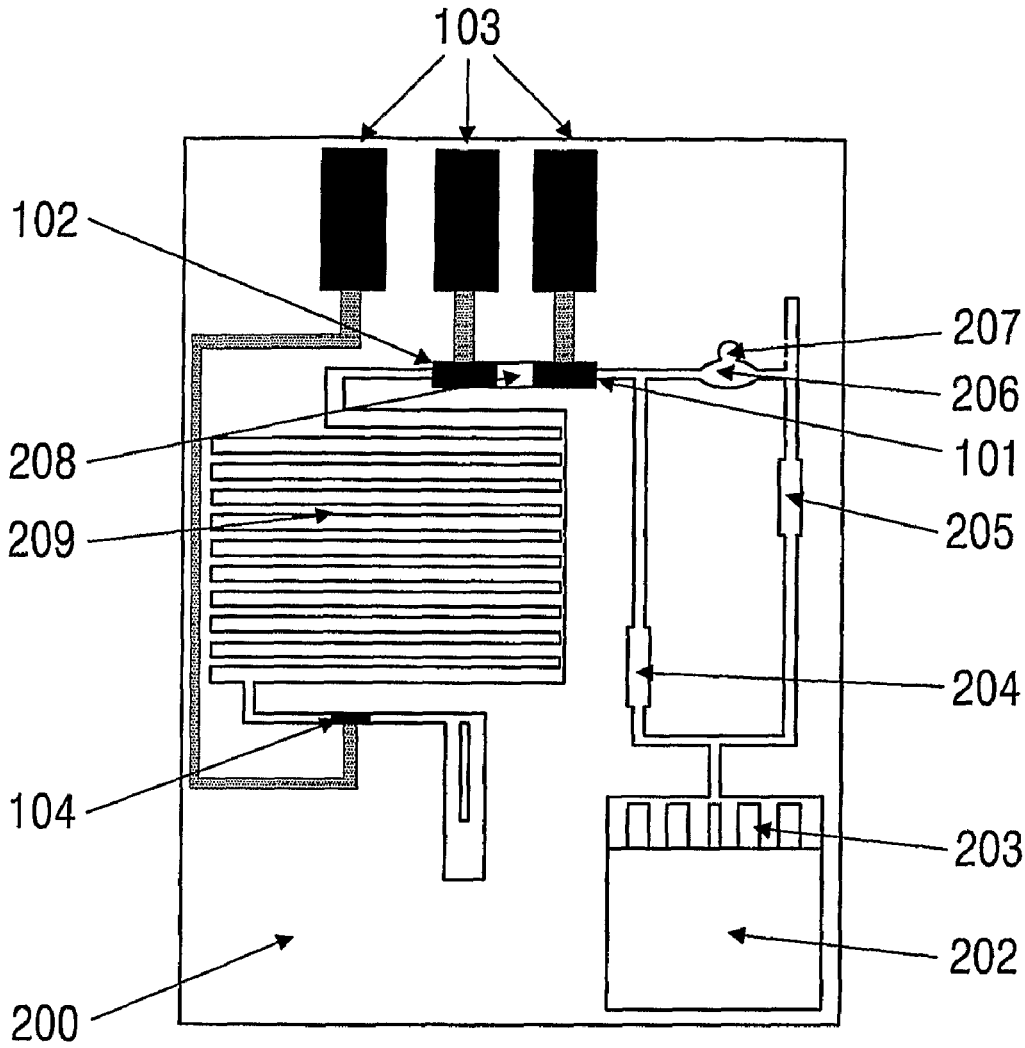
FIG. 7 is a plan view showing the microfluidic sensor complex structure of FIG. 5.

As seen in FIGS. 5 to 7, a blood filter pad channel 201 and a blood filter pad 202 are installed in the sample inlet channel 203. The blood filter pad 202 is designed to filter off blood corpuscles and introduce only serum to the sample inlet channel 203. Since the analyte of interest is, in the most part, present in sera and the large sizes of blood corpuscles disrupt the measurement of the analyte, it can be analyzed further accurately when the blood corpuscles are filtered off.

In addition, the microfluidic sensor complex structure according to the present invention preferably further comprises, in the lower plate, a sensor means for detecting the access of the sample to the end of the absorbing channel of the middle plate.

When a sample is introduced to the sample inlet channel 203 and moves to the absorbing channel 209 through the enzyme conjugate reservoir 204 and the detection channel 208, the substrate migrates from the substrate reservoir 205 to the detection channel 208 so that signals can be detected. Preferably, a sensing means 104 for indicating the time point at which the substrate starts to move toward the detection channel 208 is provided. For example, the sensing means may be a fluid sensing electrode. When sensing the inflow of the sample, the fluid sensing electrode 104, located within the absorbing channel 209, may be adapted to read a micro signal and convert it into a sound, thus informing the user of the introduction time. The sensing means can increase the reproducibility of the measurement results. The sensing means may be arranged depending on the structure of the absorbing channel 209, and is preferably located at an end region of the absorbing channel 209 such that the washing process can be properly conducted after the completion of the immune response. By quantitatively analyzing the introduced sample, the length and width of the microfluidic channel passage, running after the sensing means, can be determined.

When the sensing means detects the inflow of the sample and indicates the introduction time point, an air discharge channel 207 is formed physically, for example, using a sharp tool, e.g., a needle, or the air discharge channel, previously formed, is opened to thus advance the substrate toward the electrode unit. Thereafter, the analyte of the sample is electrochemically analyzed in the detection channel to determine the level of the analyte in the blood.

The detection channel is adapted to send the electrochemical signal generated upon the enzyme-substrate reaction, between the enzyme conjugate and the substrate fluid after the immune response of the antibody or the response of the molecule recognizing substance to the analyte, so as to yield quantitative information on the analyte.

The absorbing channel plays a role in driving the movement of the sample by maintaining a capillary phenomenon throughout the microfluidic channel passage so as to continue the reactions in the detection channel. Also, the absorbing channel serves to increase the effect of washing the unreacted material in order to produce highly sensitive detection signals.

Furthermore, the microfluidic sensor complex structure according to the present invention further comprises at least one verifying electrode in the lower plate in order to minimize the deviation of the detected signals.

Figure 8:
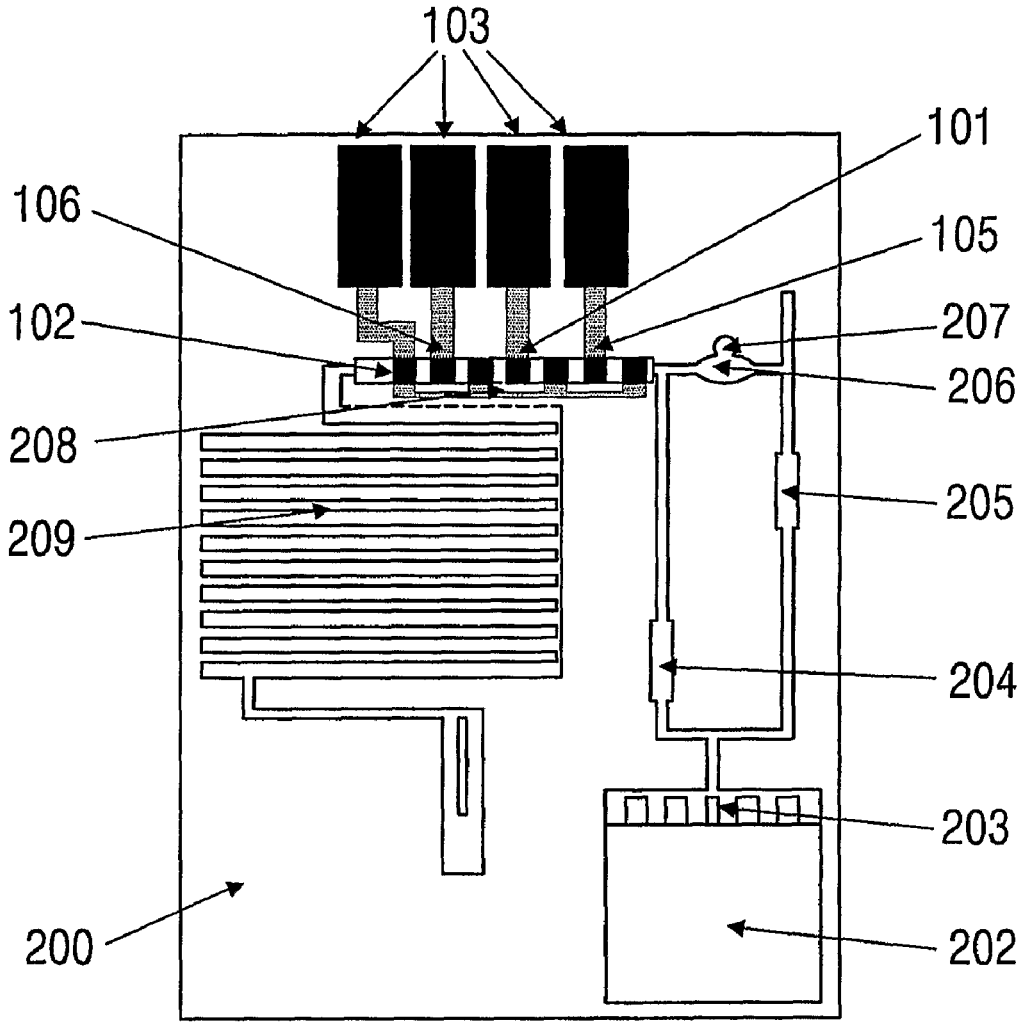
FIG. 8 is a plan view showing a microfluidic channel passage formed on the microfluidic sensor complex structure according to one embodiment of the present invention.

Referring to FIG. 8, a microfluidic sensor complex structure according to a further embodiment of the present invention is shown in a plan view, which comprises two self-verifying electrodes (a first verifying electrode 105 and a second verifying electrode 106) in the detection channel 208.

Using the verifying electrodes, repetitive signals are measured and the mean value thereof is determined as a standard signal value (background signal value or saturation signal value). The signals, detected by the working electrode 101, are corrected in comparison with the standard signal value so that variation between experiments can be reduced.

In the microfluidic sensor complex structure of FIG. 8, for instance, the first verifying electrode 105 is provided to measure a background signal, the working electrode 101 is provided to immobilize an antibody to an analyte of interest and to measure detecting signals according to concentrations of the analyte, and the second verifying electrode 106 is provided to detect the saturation signal of the saturated or partially saturated enzyme conjugate. Through the first verifying electrode 105, whether a non-specific reaction takes place between the antibody and the enzyme conjugate can be examined. The second verifying electrode 106 is adapted to examine whether the problem of the enzyme conjugate resides in the amount thereof or in the solubility thereof. The three electrodes (the working electrode 101, the first verifying electrode 105, and the second verifying electrode 106) are connected to the reference electrode 102 to measure the concentration of the analyte. This can be performed using a detector. No limitations are imposed on the number or the position of the verifying electrode.

The microfluidic sensor complex structure according to the present invention can be fabricated as follows.

First, the electrode unit (the working electrode 101, the reference electrode 102, the electrode connection 103, and the fluid sensing electrode 104) is formed by printing or depositing a carbon or metal substrate on the lower plate 100. A microfluidic channel passage, including the sample inlet channel 203, the enzyme conjugate reservoir 204, the mixing channel 206, the air discharge channel 207, the detection channel 208, and the absorbing channel 209, is formed in the middle plate. The formation of the microfluidic channel passage may be achieved using a press molding method, by applying a pressing mold to a piece of double-side tape made of an organic polymer, or using a photolithography method with a dry photoresist film. Thereafter, an antibody or a molecule-recognizing substance is immobilized on the exposed working electrode 101 and respective reservoirs 204 and 205 thereof are lined with an enzyme conjugate and a substrate. Following the fixation of the components under appropriate conditions, a sample inlet channel and an air inlet channel are installed such that a capillary phenomenon is maintained throughout the microfluidic sensor complex structure.

The immobilization of the antibody or the molecule recognizing substance onto the working electrode 101 may be achieved physically or chemically. In this regard, a physical adsorption method, which utilizes the lipophilicity between the antibody and the electrode, may be applied to the immobilization. A drop of a diluted antibody solution is loaded on the working electrode 101 and dried under appropriate conditions. Thus, the physical method is simple and takes only a short time period for the immobilization. As for a chemical method, an antibody is attached to the surface of the electrode via a covalent linker, such as a primary amine group, a thiol group or a carbohydrate, so that the functional molecules can be arranged at high density for a long time period on the surface of the electrode.

In order to perform the function thereof, the enzyme conjugate applied to the enzyme conjugate reservoir 204 must be dissolved in a sample. A rapid freeze-drying method is preferably used in order to coat the enzyme conjugate reservoir 204 with the enzyme conjugate, which may then be dissolved with the aid of additives. As such, proteins (BSA, non-fat dry milk, casein, etc) and saccharides (glucose, sucrose, trehalose, etc.) are used in preparing an enzyme conjugate solution. The proteins serve to maintain antibody activity, protect antibodies from proteinases, and reduce non-specific absorption. Saccharides are used as stabilizers to prevent the crystallization of proteins and maintain protein structures upon drying. In addition, surfactants (Tween 20, Tween 80, Triton X-100) are used to increase enzyme activity. The enzyme conjugate solution may also include metal ions that are necessary for the activity of the enzyme used. The enzyme stored in the enzyme conjugate reservoir may be selected from among various enzymes depending on the substrate used. For example, glucose oxidase requires glucose as the substrate thereof. Alkaline phosphatase is used together with p-aminophenyl phosphate as a substrate. For horseradish peroxidase, peroxide is employed when measuring reduced currents. Serving as labels, these enzymes enable the electrochemical detection of an analyte. Also, various antibodies or molecule-recognizing substances can be applied to the microfluidic sensor complex structure of the present invention in order to analyze levels of organics or inorganics in bio-samples, such as environmental samples, agricultural samples, or food samples.

Figure 10:
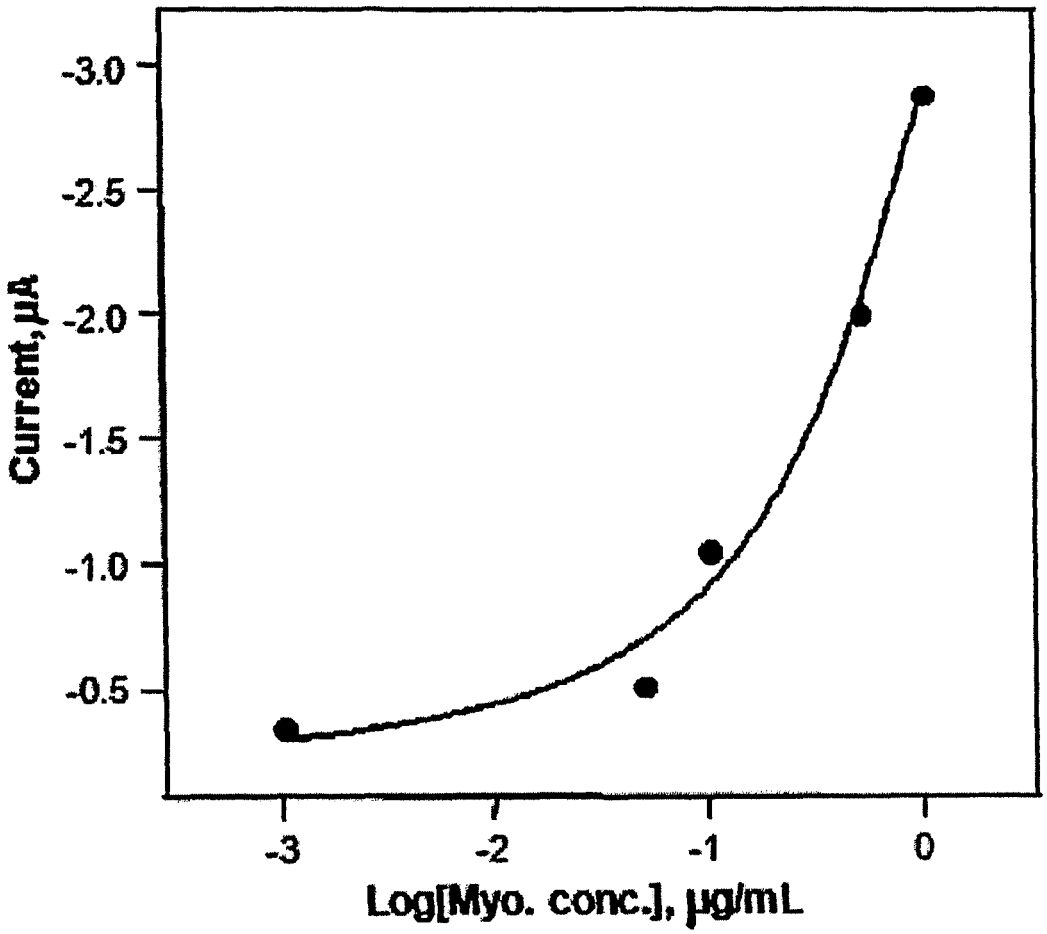
FIG. 10 is a calibration curve of current values versus the amounts of myoglobin, measured by the microfluidic sensor complex structure according to an embodiment of the present invention.

Also, the present invention is directed to a method for quantitatively analyzing an analyte using the microfluidic sensor complex structure. For example, when the microfluidic sensor complex structure according to the present invention is applied to the measurement of current values according to the amount of myoglobin, as shown in FIG. 10, it was found that current values were proportional to the level of myoglobin, with a standard deviation ranging from 0.02 to 0.18. Thus, the microfluidic sensor complex structure according to the present invention is highly sensitive and applicable to the quantitative analysis of various analytes.

As described above, the microfluidic sensor complex structure according to the present invention can be produced on a mass scale because it can be easily fabricated from organic polymers. Also, when a sample is introduced into the sample inlet channel, it can move throughout the microfluidic channel because the motion is driven by a capillary phenomenon. Thus, the microfluidic sensor complex structure can be used as an immunosensor in which a sample can dissolve components and induce an immune response and can be washed and quantitatively measured, so as to afford rapid and accurate analysis results. The flow of the sample is controlled in the capillary passages without values or pumps, so that the microfluidic sensor complex structure can be fabricated at a low cost and can be simply operated. Thus, the microfluidic sensor complex structure is useful as a biosensor applicable to various analytes.

MODE FOR THE INVENTION

A better understanding of the present invention may be obtained through the following examples, which are set forth to illustrate, but are not to be construed as the limit of the present invention

Example 1

Fabrication of Microfluidic Sensor for Quantitative Analysis of Myoglobin 1

(1) Preparation of Electrode and Microfluidic Channel Passage

A microfluidic channel passage was formed using photolithography, which is generally used in semiconductor technology. In this regard, an acryl-coated polyethylene terephthalate (PET) film was used as a plate. A carbon paste was screen-printed on the film to form a working electrode, an electrode connection and a fluidity sensing electrode. A reference electrode and an electrode connection were formed with a silver paste. A dry photoresist film was thermally pressurized against the film on which the electrodes were formed, followed by the formation of a microfluidic channel passage using an exposure system. The microfluidic channel passage was designed with a CAD program and printed on an OHP film, which was then used as a pattern mask. After being exposed to a UV beam at a predetermined dose, the dry photoresist film was etched with a 2% sodium carbonate solution to form a pattern. The etchant was maintained at 30° C. The sensor chip thus prepared was dried and stored under a shade condition.

(2) Immobilization of Antibody, Enzyme-Conjugate and Substrate

A myoglobin antibody was physically immobilized on the working electrode. First, a dilution of a myoglobin antibody in a 0.01M phosphate buffer at pH 7.2 was dropped onto the working electrode and dried at 25° C. An enzyme conjugate applied to an enzyme conjugate reservoir was a secondary myoglobin antibody conjugated with an alkaline phosphatase which allowed a sandwich enzyme immunoassay to be used for the analysis thereof. A dilution of an enzyme conjugate was placed in a predetermined amount on the enzyme conjugate reservoir and dried at 25° C. The enzyme conjugate was diluted in a buffer containing 20 mM phosphate buffer, pH 7.2, 0.5% BSA, 1% trehalose, 0.1% polyvinyl alcohol (PVA), and 0.01% Tween 20. To the dilution buffer were added various agents adapted to migrate the enzyme conjugate after it was solubilized. In a substrate reservoir, 4-aminophenyl phosphate, serving as a substrate of alkaline phosphatase, was concentrated by drying a solution thereof. The solution contained 1.0 M carbonate buffer, 0.5% trehalose, 0.05% Tween 20, and 0.5% CMC (carboxy methyl cellulose) in order to hydrate the substrate in a short time period.

Afterwards, a poly-ethylene terephthalate (PET) film, one surface of which served as an adhesive tape, was applied to the middle plate to produce a microfluidic sensor.

Example 2

Fabrication of Microfluidic Sensor for Quantitative Analysis of Myoglobin 2

A microfluidic sensor was fabricated in the same manner as set forth in Example 1, with the exception that a blood filter pad was provided at the sample inlet channel and a fluidity sensing electrode was installed at an end region of the absorbing channel.

The blood filter pad was commercially available from Lydall Filtration, identified as LyPore Grade 9389. Like the working electrode, the fluidity sensing electrode was prepared from a carbon paste.

Example 3

Fabrication of Microfluidic Sensor for Quantitative Analysis of Myoglobin 3

A microfluidic sensor was fabricated in the same manner as explained in Example 1, with the exception that two verifying electrodes were further installed. The two verifying electrodes were formed of carbon paste and coated with BSA for a first verifying electrode and with IgG for a second verifying electrode.

Coated with BAS, the first verifying electrode was adapted to detect background signals while the second verifying electrode, coated with the same IgG as in the control line of a rapid kit, was adapted to monitor the solution of the enzyme conjugate by binding to unreacted enzyme conjugate, that is, to monitor saturation signals.

Example 4

Fabrication of Microfluidic Sensor for Quantitative Analysis of Antibiotics 1

A fabrication of microfluidic sensor for quantitative analysis of antibiotics (eg. Tetracycline, Chloramphenicol, ampicillin, Sulfadimethoxine, etc.) is identical to that for quantitative analysis of myoglobin. Antibiotics is measured with a competitive enzyme immunoassay, not by a sandwich enzyme immunoassay because it has a little molecular weight. The antibiotics and enzyme conjugate can be competitive by immobilizing antibody onto working electrode.

A dilution of an antibiotics antibody in a 0.01 M phosphate buffer at pH 7.2 was dropped onto the working electrode and dried at 25° C. An enzyme conjugate applied to an enzyme conjugate reservoir was an antibiotics-HRP (horseradish peroxidase) conjugate which was conjugated to antibiotics directly using HRP. To the dilution buffer were added various agents adapted to migrate the enzyme conjugate after it was solubilized. In a substrate reservoir, peroxide and TMB (3,3', 5,5'-tetramethyl benzidine), serving as a substrate of HRP, was concentrated by drying a solution thereof.

Afterwards, a poly-ethylene terephthalate (PET) film, one surface of which served as an adhesive tape, was applied to the middle plate to produce a microfluidic sensor.

Example 5

Fabrication of Microfluidic Sensor for Quantitative Analysis of Antibiotics 2

A competitive enzyme immunoassay can be designed differently from the Example 4. With immobilizing an antibiotics-protein conjugate onto working electrode, it is possible to make both an immobilized antibiotics-protein conjugate and free antibiotics become competitive onto antibiotics antibody-enzyme conjugate.

An antibiotics-BSA (or BTG, OVA) was physically immobilized on the working electrode and dried. An enzyme conjugate applied to an enzyme conjugate reservoir was an antibody-enzyme conjugate prepared with alkaline phosphatase. In a substrate reservoir, 4-aminophenyl phosphate, serving as a substrate of alkaline phosphatase, was applied.

Afterwards, an adhesive tape was applied to the middle plate to produce a microfluidic sensor.

Experimental Example 1

Measurement of Myoglobin Concentration

The following experiment was conducted to examine whether the microfluidic sensor complex structure according to the present invention could be used as a biosensor.

Blood plasma containing myoglobin at a concentration of 0, 0.01, 0.05, 0.1, 0.5, or 1 μg/ml was introduced into the sample inlet channel of the microfluidic sensor fabricated in Example 1. When the sample reached the fluidity sensing electrode of the absorbing channel, the air discharge channel was opened using a needle such that the hydrated substrate was allowed to flow into the electrode unit. Thereafter, each electrode was applied with a potential of +150 mV using an EZ potentiostat program, and the currents were measured for 60 sec. The results are graphed in FIG. 10 and summarized in Table 1, below.

TABLE

| | Myo (μg/ml) | | | | |
|---|---|---|---|---|---|
| | 0 | 0.05 | 0.1 | 0.5 | 1 |
| Currents (μA) | −0.37 | −0.52 | −1.01 | −2.01 | −2.88 |
| | −0.32 | −0.50 | −1.06 | −1.95 | −2.68 |
| | −0.35 | −0.47 | −1.08 | −2.11 | −3.09 |
| | −0.33 | −0.63 | −0.97 | −2.05 | −2.76 |
| | −0.34 | −0.48 | −1.18 | −1.89 | −3.07 |
| Mean | −0.34 | −0.52 | −1.06 | −2.00 | −2.90 |
| SD | 0.02 | 0.06 | 0.08 | 0.09 | 0.18 |
| CV (%) | 5.62 | 12.39 | 7.52 | 4.27 | 6.30 |

As seen in FIG. 10 and Table 1, the currents varied depending on the concentration of myoglobin, and the sensitive slope had a linearity of 0.786 in the range from 0 to 0.1 μg/ml and a linearity of 0.977 in the range from 0.1 to 1 μg/ml, indicating that the microfluidic sensor complex structure can be used as a biosensor in the quantitative analysis of bio analytes.

Therefore, the microfluidic sensor complex structure according to the present invention is useful as a biosensor applicable to the analysis of various analytes.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A microfluidic sensor complex structure, comprising:

a lower plate, on which a reference electrode, a working electrode and an electrode connection are formed;

wherein the lower plate is further provided with one or more verifying electrodes configured to minimize the deviation of detected signals, wherein the verifying electrodes are comprised of a first verifying electrode, for measuring a background signal, and a second verifying electrode for detecting a saturation signal of the saturated or partially saturated enzyme conjugate, a middle plate, overlaid on the lower plate, comprising therein:

a sample inlet channel;

a microfluidic channel passage, which extends from the sample inlet channel and serves as a guide along which a sample flows over the entire middle plate, and which is divided at a position near the sample inlet channel into two branches, on which an enzyme conjugate reservoir and a substrate reservoir are positioned, respectively, said two branches being confluent before a detection channel, at which the reference electrode and the working electrode are exposed;

a mixing channel, positioned before a position of confluence on the microfluidic channel passage extending through the substrate reservoir, comprising an air discharge channel such that a sample flowing through the substrate reservoir reaches the detection channel later than does a sample flowing through the enzyme conjugate reservoir;

an absorbing channel in which the sample fluid flowing out of the detection channel is absorbed;

an air inlet channel provided at an end of the absorbing channel; and an upper plate, overlaid on the middle plate so as to induce a capillary phenomenon on the microfluidic channel passage formed on in the middle plate.

2. The microfluidic sensor complex structure according to claim 1, wherein the lower plate is provided with a fluidity sensing electrode for detecting arrival of the sample at the end of the absorbing channel of the middle plate.

3. The microfluidic sensor complex structure according to claim 2, wherein the fluidity sensing electrode is configured to indicate a time point at which the substrate is allowed to advance further by detecting the arrival of the sample.

4. The microfluidic sensor complex structure according to claim 1, wherein the middle plate is further provided with a filter pad channel and a filter pad, both of which are adapted to select only an analyte component of the sample.

5. The microfluidic sensor complex structure according to claim 4, wherein the filter pad is designed to introduce only serum to the sample inlet channel.

6. The microfluidic sensor complex structure according to claim 1, wherein the sample flowing out of the enzyme conjugate reservoir reaches the working electrode a predetermined time period earlier than does the sample flowing out of the substrate reservoir.

7. The microfluidic sensor complex structure according to claim 1, wherein an antibody or a molecule-recognizing substance capable of inducing an immune response to an analyte of the sample are immobilized on the working electrode.

8. The microfluidic sensor complex structure according to claim 1, wherein the detection channel is adapted to send the electrochemical signal, generated upon an enzyme-substrate reaction between the enzyme conjugate and the substrate fluid after the immune response of the antibody or molecule-recognizing substance to the analyte, so as to yield quantitative information on the analyte.

9. The microfluidic sensor complex structure according to claim 1, wherein the absorbing channel maintains a capillary phenomenon over the microfluidic channel passage to drive movement of the sample, thereby continuing reactions in the detection channel, and serves to increase a washing effect on an unreacted material to produce highly sensitive detection signals.

10. The microfluidic sensor complex structure according to claim 1, wherein the upper plate is overlaid on the middle plate in such a manner as to expose the sample inlet channel and a terminal region of the absorbing channel, thereby inducing a capillary phenomenon on the microfluidic sensor complex structure.

11. A method for quantitatively analyzing an analyte using the microfluidic sensor complex structure of claim 1.

* * * * *